US005714994A

United States Patent [19]

Suzuki et al.

[11] Patent Number: 5,714,994

[45] Date of Patent: Feb. 3, 1998

[54] THERMAL PRINTER WITH POWER SAVE FEATURE

[75] Inventors: Minoru Suzuki; Kiyoshi Negishi; Katsumi Kawamura; Mikio Horie; Hiroshi Orita; Katsuyoshi Suzuki, all of Tokyo, Japan

[73] Assignee: Asahi Kogaku Kogyo Kabushiki Kaisha, Tokyo, Japan

[21] Appl. No.: 489,139

[22] Filed: Jun. 9, 1995

[30] Foreign Application Priority Data

Jun. 9, 1994 [JP] Japan ..... 6-151486

[51] Int. Cl.[6] ..... B41J 2/35

[52] U.S. Cl. ..... 347/190; 347/192

[58] Field of Search ..... 347/190, 192, 347/194; 400/120.1, 120.12, 120.14; 364/483, 707

[56] References Cited

U.S. PATENT DOCUMENTS

| | | | |
|---|---|---|---|
| 4,510,505 | 4/1985 | Fukui | 347/190 |
| 4,984,185 | 1/1991 | Saito | 364/707 |
| 5,311,441 | 5/1994 | Tayama et al. | 364/707 |
| 5,524,993 | 6/1996 | Durst | 400/120.14 |

FOREIGN PATENT DOCUMENTS

| | | | |
|---|---|---|---|
| 58-05280 | 1/1983 | Japan | 347/192 |
| 58-12763 | 1/1983 | Japan | 347/192 |
| 4-113860 | 4/1992 | Japan | 347/192 |

*Primary Examiner*—Huan H. Tran

*Attorney, Agent, or Firm*—Greenblum & Bernstein P.L.C.

[57] ABSTRACT

A portable printer forms a portion of an image in accordance with image data. A built-in battery provides energy to form the portion of the image. The portable printer predicts whether a remaining capacity of the battery, after the portion of the image has been formed, will be larger than a predetermined reference termination value. The portion of the image is not formed if the remaining capacity of the battery is predicted to be less than the predetermined value.

11 Claims, 7 Drawing Sheets

I / F
27
PDATA1~8
DATASTB
BUSY
ACK
107
108 LED
109
GND
G / A
26
X'tal
15
GND
GND
40
41
THERMAL HEAD
CLK
DATA1
DATA2
STB1
STB2
STB3
STB4
CHARGE
REFRESH
CHARGE CONTROL CCT.
60
70
CC
CV
GND
GND
80
81
82
51
52
53
VCC
32
M
31
MOTOR DRIVE CCT.
ADPT.IN
GND
90
Batt.
GND
POWER SW
106
GND
VH
VCC
50
DC/DC CONVERTER
VCC
SW
V-Batt
GND
CPU
AB
DB
AB23~0
DB15~0
AN1
Port1
Port2
Port3
Port4
Port5
Port6
A
A
B
B
Port7
PON2
PON1
Port 8
AN2
RESET
PTOP
10
24
RESET IC
25
21
EPROM
22
DRAM
23
ROM

THERMAL PRINTER WITH POWER SAVE FEATURE

BACKGROUND OF THE INVENTION

The present invention relates to a printer having a built-in battery to power a thermal head, sheet feeding mechanism and other related hardware.

Recently, there has been an increased demand for small printers for use used with laptop computers. To make the printers portable, the printers are provided with a built-in battery. The built-in battery is usually a rechargeable battery, such as a nickel cadmium battery. When the printer is not in use and connected to a power source, such as a 120 V AC supply, the built-in battery is charged.

When the nickel cadmium battery is fully charged, the voltage output by the battery is at a rated maximum voltage of the battery. As the energy in the battery is consumed, the output voltage is reduced. Further, if the output voltage of the battery is below a predetermined value and the battery is used to power the printer, then the life of the battery is shortened.

Therefore, the printer constantly monitors the output voltage of the battery when the output voltage falls below the predetermined value, the operation of the printer is terminated. However, since the voltage of the battery fluctuates during the printing operation, the operation of the printer may be terminated too early, thereby reducing the effective time that the battery can be used before the battery must be recharged.

SUMMARY OF THE INVENTION

It is therefore an object of the present invention to provide an improved printer, which extends the length of battery can be used before the battery needs to be recharged.

According to an aspect of the present invention, there is provided a portable printer having a mechanism for forming a portion of an image in accordance with image data, a built-in battery for providing energy to the image forming mechanism and mechanism for driving the image forming mechanism to form the portion of the image. The printer predicts whether a remaining capacity of the battery after the portion of the image has been formed will be larger than a predetermined value, and inhibits the driving mechanism from driving the image forming mechanism if the remaining capacity is predicted to be less than the predetermined value.

Therefore, the printer determines whether a portion of the image such as a line, can be printed, by taking into consideration the data that is to be printed. This results in the maximum utilization of the remaining capacity of the battery.

According to a further feature of the invention, the printer detects an initial voltage of the battery before forming the portion of the image, and then predicts the remaining capacity of the battery based on the detected initial voltage and the image data of the portion of the image to be formed.

According to a further feature of the invention, the image forming mechanism includes a thermal head having a plurality of linearly arranged thermal elements. The number of thermal elements to be driven to form the portion of the image is determined in accordance with the image data. The printer predicts the remaining capacity of the battery based on the number of thermal elements to be driven.

In this type of printer, the amount of energy consumed by the thermal head is proportional to the number of black dots of the image that are to be formed by the thermal elements.

Therefore, formation of a dark image will require a higher remaining capacity than the formation of a light image.

The number of thermal elements to be driven to form the portion of the image corresponds to a printing ratio of the portion of the image.

Alternatively, the printer predicts whether a final voltage of the battery after the portion of the image has been formed, will be larger than a predetermined voltage value. The remaining capacity of the battery is then determined in accordance with the predicted final voltage and the number of thermal elements to be driven.

Further, the predetermined voltage value corresponds to a termination voltage value. To to form an image, the final voltage value must be larger than the termination voltage value.

In the preferred embodiment, the built-in battery is a Nickel Cadmium battery.

According to another embodiment of the present invention, there is provided a portable printer including a mechanism for forming a line image on a recording sheet in accordance with image data, and a built-in battery for providing energy to the image forming mechanism. The printer determines a printing ratio of a line of the image to be formed, and the predicts whether a final voltage of the battery after the line of the image has been formed will be larger than a predetermined value. The final voltage of the battery is predicted in accordance with the printing ratio. The image forming mechanism is then driven to form the line image only if the final voltage is predicted to be larger than the predetermined value.

Therefore, if the final voltage is lower than the predetermined value, it will not be possible to form the image, and thus, the printer will inhibit the image forming means from forming an image.

According to a further aspect of the present invention, there is provided a method for forming a line of an image on a recording sheet using a portable printer having a built-in battery, the method comprising:

- detecting an initial voltage of the built-in battery before the line of the image is formed;
- determining a printing ratio of the line of the image to be printed, based on image data corresponding to the line of the image;
- predicting whether a remaining capacity of the battery after the line of the image has been formed, will be larger than a predetermined value; and
- forming the line of the image if the final voltage is predicted to be larger than the predetermined value.

DESCRIPTION OF THE EMBODIMENTS

Figure 1:
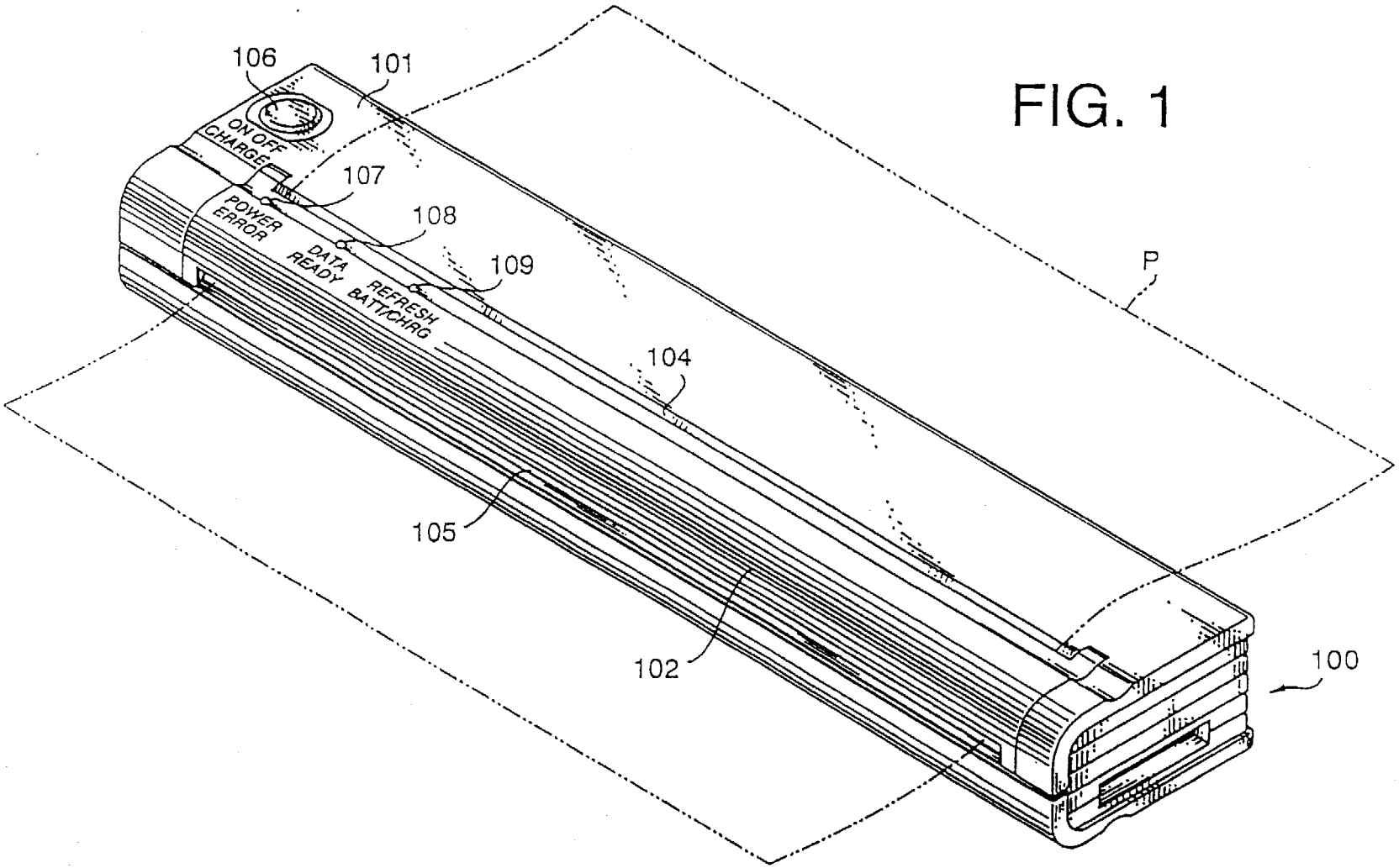
FIG. 1 shows a perspective view of a thermal printer embodying the present invention.

FIG. 1 is a perspective view of a thermal printer 100 embodying the mode control system according to the present invention. The thermal printer 100 has a main housing 101, and a platen roller cover 102. The platen roller cover 102 is hinged, and can be swing to expose a platen roller (not shown) is.

Three indicators 107, 108 and 109 are formed on a top surface of the platen roller cover 102. In this embodiment, the three indicators 107, 108 and 109 are LEDs. The indicator 107 indicates whether the power in ON or OFF. The indicator 108 indicates whether data is being received. The indicator 109 indicates information about the operation of a built-in battery (not shown in FIG. 1), such as whether the built-in battery is being refreshed (i.e., completely discharged) or charged.

Paper for use with the thermal printer 100 is fed into a slot 104 formed between the platen roller cover 102 and the housing 101. An image is formed on the paper using a thermal printing head 41 (see FIG. 2). The paper then exits the thermal printer 100 through a slot 105, formed between the platen roller cover 102 and the housing 102.

A mode switch 106 is located on the top surface of the housing 101. The mode switch 106 is a push button switch and is normally open. By pressing the mode switch 106, various modes of operation of the thermal printer 100 are selected. In the present embodiment, the mode switch 106 also turns the power ON and OFF.

Figure 2:
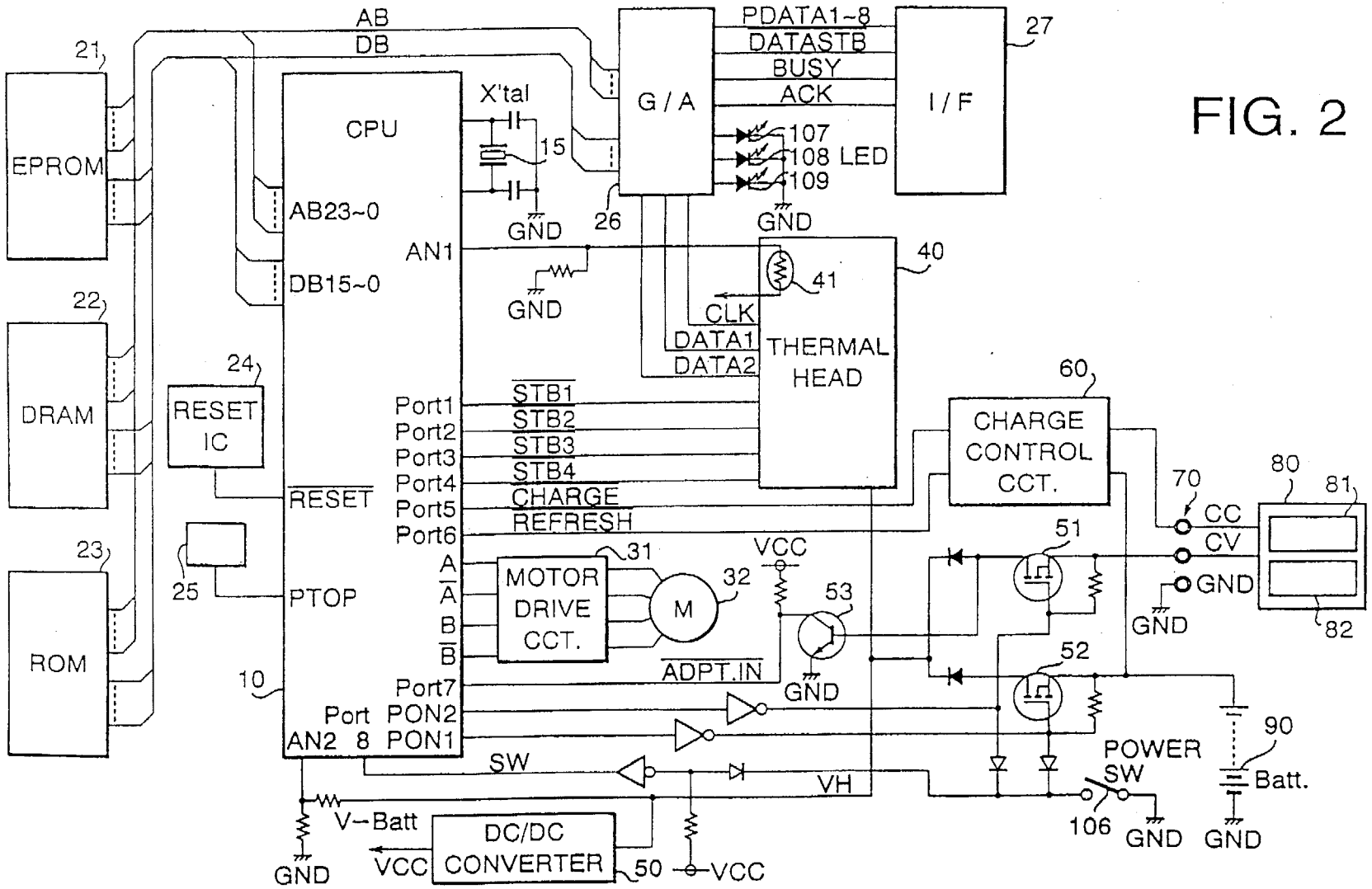
FIG. 2 shows a schematic diagram of the thermal printer shown in FIG. 1.

FIG. 2 is a schematic diagram of the thermal printer 100 shown in FIG. 1.

A CPU 10 controls an operation of the thermal printer 100. In the present embodiment, the CPU 10 is a microprocessor which can address up to 16 MB (megabytes). The CPU 10 transmits address information from address ports ABO through AB23, along an address bus AB. The CPU 10 transmits and receives data through data ports DBO through DB15 and a data bus DB. The CPU 10 connects to an EPROM 21, a DRAM 22, a font ROM 23, and a gate array 26, via the address bus AB and data bus DB.

The EPROM 21 stores data and software that control printer performance, as well as an initial operation of the thermal printer 100 when the power is turned ON. The DRAM 22 (dynamic RAM) has an area where a bit-map of the image is developed, an area for storing data transmitted through an interface 27, and some other work areas. The font ROM 23 stores font data used for developing the bit-mapped image stored in the DRAM 22.

The CPU 10 uses a gate array 26 to exchange data through the interface 27, and drive the indicators 107, 108 and 109.

The interface 27 is a printer interface (e.g. Centronics interface) which receives print data and control data from a host computer (not shown). The printer interface has eight data lines PDATA 1 through PDATA 8, and three control lines $\overline{\text{DATASTB}}$, BUSY, and ACK. The eight data lines PDATA 1 through PDATA 8 transfer the print data from the host computer. The $\overline{\text{DATASTB}}$ control line the inputs of data to the printer 100 from the host computer. The BUSY control line indicates that the printer 100 cannot accept the print data, while the ACK control line acknowledges reception of the print data. In the specification, a control line, port or signal having a "bar" over its name indicates an active low control line, port or signal, respectively.

A divided voltage V_BAT of the built-in battery (or an external DC voltage) is applied to an analog port AN2 of the CPU 10. The CPU 10 A/D converts the applied analog voltage to a digital value, and detects the voltage of the built-in battery (or external DC source).

A reset IC 24 transmits a reset signal ($\overline{\text{RESET}}$) to a CPU port $\overline{\text{RESET}}$, when the detected voltage level of the battery is lower than a predetermined voltage level. When the $\overline{\text{RESET}}$ signal is LOW, the CPU 10 stops operation of the printer 100. Therefore, the printing operation stops when the voltage of the built-in battery (or external DC voltage) is below the predetermined level.

A sensor 25 mounted on the platen roller cover 102, detects the presence of the thermosensitive paper in a sheet feed path of the printer 100. If the thermosensitive paper is located in the sheet feed path, the sensor 25 transmits a paper-detect signal to a port PTOP of the CPU 10. By monitoring the port PTOP, the CPU 10 determines whether the printer 100 has thermosensitive paper loaded in the sheet feed path, and therefore whether the printer 100 is ready to start the printing operation.

A reference clock signal CLK is generated by crystal 15. In accordance with the reference clock signal CLK, the bit map of the print data is developed in the DRAM 22. The data written in the DRAM 22 is transmitted to the gate array 26 and synchronized with the reference clock signal CLK, before being transferred to the thermal print head 40. The data transferred to the thermal head 40 is separated into two separate data blocks: DATA1 and DATA2.

The thermal print head 40 has a plurality of thermal elements. The heat energy generated by each of the thermal elements is controlled by strobe signals $\overline{\text{STB1}}$, $\overline{\text{STB2}}$, $\overline{\text{STB3}}$, $\overline{\text{STB4}}$ (described later), which are transmitted from the ports Port 1 through Port 4 of the CPU 10. Thus, DATA1 and DATA2 identify the thermal elements to be driven, and strobe signals $\overline{\text{STB1}}$ through $\overline{\text{STB4}}$ drive the identified thermal elements to generate the required heat energy for printing the image.

A thermistor 41 is provided on the thermal head 40 for detecting the temperature of the thermal head 40. The output of the thermistor 41 is input to a port AN1 of the CPU 10. The CPU 10 A/D converts the signal input to the port AN1, and detects the temperature of the thermal head 40.

A motor driving signal is transmitted from ports, A, $\overline{\text{A}}$, B, $\overline{\text{B}}$, for controlling a motor driving circuit 31. The motor driving circuit 31 drives a motor 32. The motor driving circuit 31 will be described in more detail later.

A port PON1 outputs a signal for turning ON or OFF a FET 52. A port PON2 outputs a signal for turning ON or OFF a FET 51. If an external power source (such as an AC adapter) is used to power the printer 100, a transistor 53 is turned ON thereby changing the signal $\overline{\text{ADPT.IN}}$ from High to Low. The CPU 10 monitors the $\overline{\text{ADPT.IN}}$ signal at Port 7, and determines whether the external power supply is connected. If the external power supply is connected (i.e., $\overline{\text{ADPT.IN}}$ is Low), then the CPU 10 drives the FET 51 through port PON2. If the external power supply is not connected (i.e., $\overline{\text{ADPT.IN}}$ is High), then the CPU 10 drives the FET 52 through port PON1.

When the switch 106 is first turned ON, the FET 51 or 52 is turned ON, as described above. Power is supplied from the external power source or the built-in battery to a DC/DC converter 50. The DC/DC converter 50 outputs Vcc which powers the CPU 10, the EPROM 21, the DRAM 22 and the ROM 23. In this embodiment, Vcc=5V.

When the FETs 51 and 52 are turned OFF by the signals output from the Ports PON1 and PON2, power is not supplied to the DC/DC converter 50. Therefore, the power to the CPU 10 is cut off and the printer 100 is turned OFF. In order to turn the printer 100 ON, it is necessary to press the switch 106 again, thereby providing power to the FETs 51 and 52.

The built-in battery 90 is a rechargeable battery, such as a Nickel Cadmium battery. The battery 90 supplies 14.4VDC to the printer 100. A power source connector 70 is provided to connect the external power source, such as an AC adapter 80, to the printer 100. The AC adapter 80 includes a constant current source 81 and a constant voltage source 82. An output of the constant current source 81 is connected to a battery charge control circuit 60, and is used to recharge the battery 90. An output of the constant voltage source 82, is connected to an input of the DC/DC converter 50.

As described above, the constant current source 81 is part of the AC adapter 80, and not in the printer 100, since the constant current source 81 is only required for charging the battery. Therefore, the size and weight of the printer 100 can be reduced.

To maximize the efficiency of charging the battery 90, the battery 90 is first refreshed (completely discharged) before being recharged. This reduces the 'memory' effect of the battery 90. The memory effect of a battery occurs when the battery is recharged without first being fully discharged. That is, if the battery is repeatedly recharged without being fully discharged, the available battery capacity is reduced.

In the present embodiment, the refreshing of the battery 90 is controlled by the charging circuit 60. When the battery 90 is to be refreshed, the CPU 10 transmits a $\overline{\text{REFRESH}}$ signal from the Port 6 to the charge control circuit 60. The charge control circuit 60 stops charging the battery 90, the FET 51 is turned OFF, and the FET 52 is turned ON. The FET 52 connects the battery 90 to a load (not shown) to refresh the battery 90.

In this embodiment, charging of the battery 90 is also controlled by the charging circuit 60. When the battery is to be charged, the CPU 10 transmits a $\overline{\text{CHARGE}}$ signal from the Port 5. The charge control circuit 60 starts charging the battery 90 using the constant current source 81 of the AC adapter 80. The voltage of the battery 90 is monitored by the CPU 10, to determine when to stop the charging operation.

The terminal head 40 has 2560 thermal elements arranged along a line, having a length equivalent to a width of one sheet of the thermosensitive paper used in the printer 100. Print data for the first through the 1280st thermal element are grouped as the DATA1, while print data for the 1281st through the 2560th thermal element are grouped as the DATA2. Further, as described above, the data DATA1 and DATA2 are transferred to the thermal head 40 synchronously with the reference clock signal CLK.

The thermal elements are divided into four groups, with each group driven by the strobe signals $\overline{\text{STB1}}$, $\overline{\text{STB2}}$, $\overline{\text{STB3}}$, and $\overline{\text{STB4}}$, respectively. With this arrangement the number of thermal elements driven at one time may be varied in accordance with the power available form the battery 90. If the power available from the battery 90 is low, then each group of thermal elements may be driven sequentially. However, if the battery 90 is fully charged or the AC adapter 80 is used, all four groups of thermal elements may be driven simultaneously.

Figure 3:
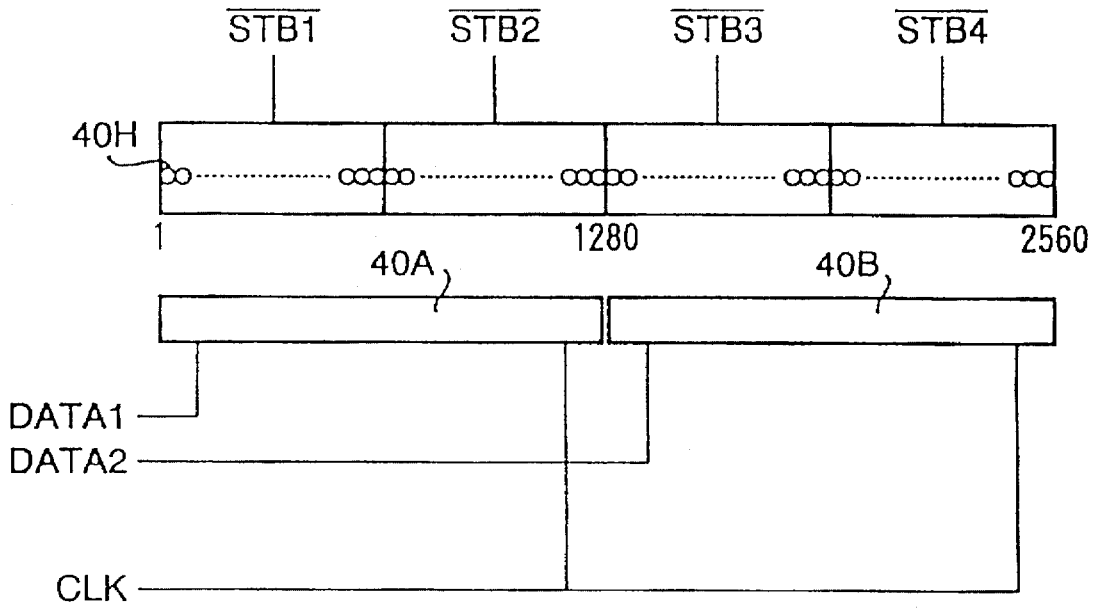
FIG. 3 shows a structure of a thermal head of the thermal printer shown in FIG. 1.

FIG. 3 illustrates a structure of the thermal head 40. Data used to drive the first through 1280th thermal elements 40H is sent from the CPU 10 to the shift register 40A synchronously with the clock signal CLK. Similarly data used to drive the 1281st through 2560th thermal elements 40H is sent from the CPU 10 to the shift register 40B synchronously with the clock signal CLK. Each bit of the shift registers 40A and 40B store data which drive one of the thermal elements 40H. If the data value of the bit stored in the shift register is "1", then the corresponding thermal element is driven (i.e., turned ON) when the strobe signal $\overline{\text{STBn}}$ is LOW.

Figure 4:
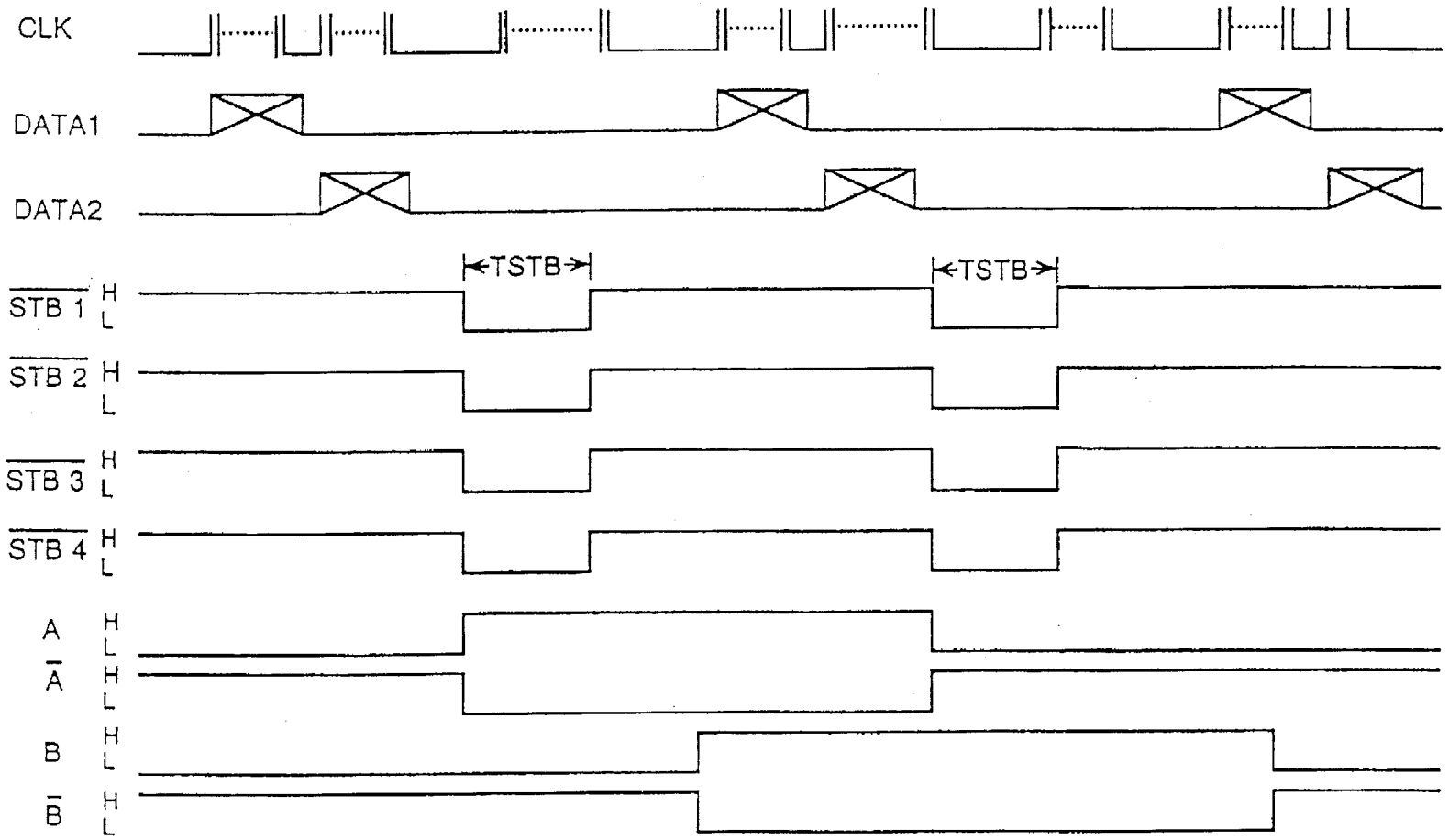
FIG. 4 is a timing diagram of the control of the thermal head and motor.

FIG. 4 is a timing diagram showing the transfer of data to the thermal head 40, the driving of the thermal head 40 and the driving of the motor 32.

After a bit map has been developed in the DRAM 22, the data to be printed by the thermal elements 40H is transmitted from the gate array 26 to the shift registers 40A and 40B. Initially DATA1 which corresponds to the data to drive the first through 1280th thermal elements 40H is transmitted synchronously with the clock signal CLK, and stored in the shift register 40A. After DATA1 has been stored, the strobe signals $\overline{\text{STB1}}$ and $\overline{\text{STB2}}$ are made LOW for a predetermined time interval in order to drive the first through 1280th thermal elements 40H. Simultaneously, the motor 32 is driven to feed the thermal sheet a predetermined amount.

When the strobe signals $\overline{\text{STB1}}$ and $\overline{\text{STB2}}$ are LOW, the first through 1280th thermal elements 40H are driven. Further, DATA2 which corresponds to the data to drive the 1281st through 2560the thermal elements 40H, is transmitted synchronously during time interval TSTB, and stored in the shift register 40B. Therefore, after driving the strobe signals $\overline{\text{STB1}}$ and $\overline{\text{STB2}}$, DATA2, which has been stored in shift register 40B is transferred to the respective thermal elements 40H. Thus, during the next time interval TSTB, the strobe signals $\overline{\text{STB3}}$ and $\overline{\text{STB4}}$ are tied LOW, and the 1281st through 2560th thermal elements 40H are driven. During the next time interval TSTB, DATA1 for the next line is transferred to the shift register 40A, and the above process repeats. Subsequent lines are printed in a similar manner.

In this embodiment, a two phase exciting method is used to drive the motor 32. Motor driving pulses A, $\overline{\text{A}}$, B, and $\overline{\text{B}}$ are sent from the CPU 10 to the motor 32 in one of two states, HIGH or LOW. Initially the states of the motor driving pulses are as follows: A=LOW, $\overline{\text{A}}$=HIGH, B=LOW, and $\overline{\text{B}}$=HIGH. When the states of two of the motor driving pulses (i.e., A and $\overline{\text{A}}$) are changed, the motor 32 feeds the thermal printer half a line. As shown in FIG. 4, the states of driving pulses A and $\overline{\text{A}}$ are changed while the strobe signals $\overline{\text{STB1}}$ and $\overline{\text{STB2}}$ are LOW. Then, while the strobe signals $\overline{\text{STB3}}$ and $\overline{\text{STB4}}$ are LOW, the states of motor driving pulses B and $\overline{\text{B}}$ are changed, and the motor 32 feeds the thermal paper another half line. The thermal printer is then ready to accept the next set of data to be printed.

Figure 5A:
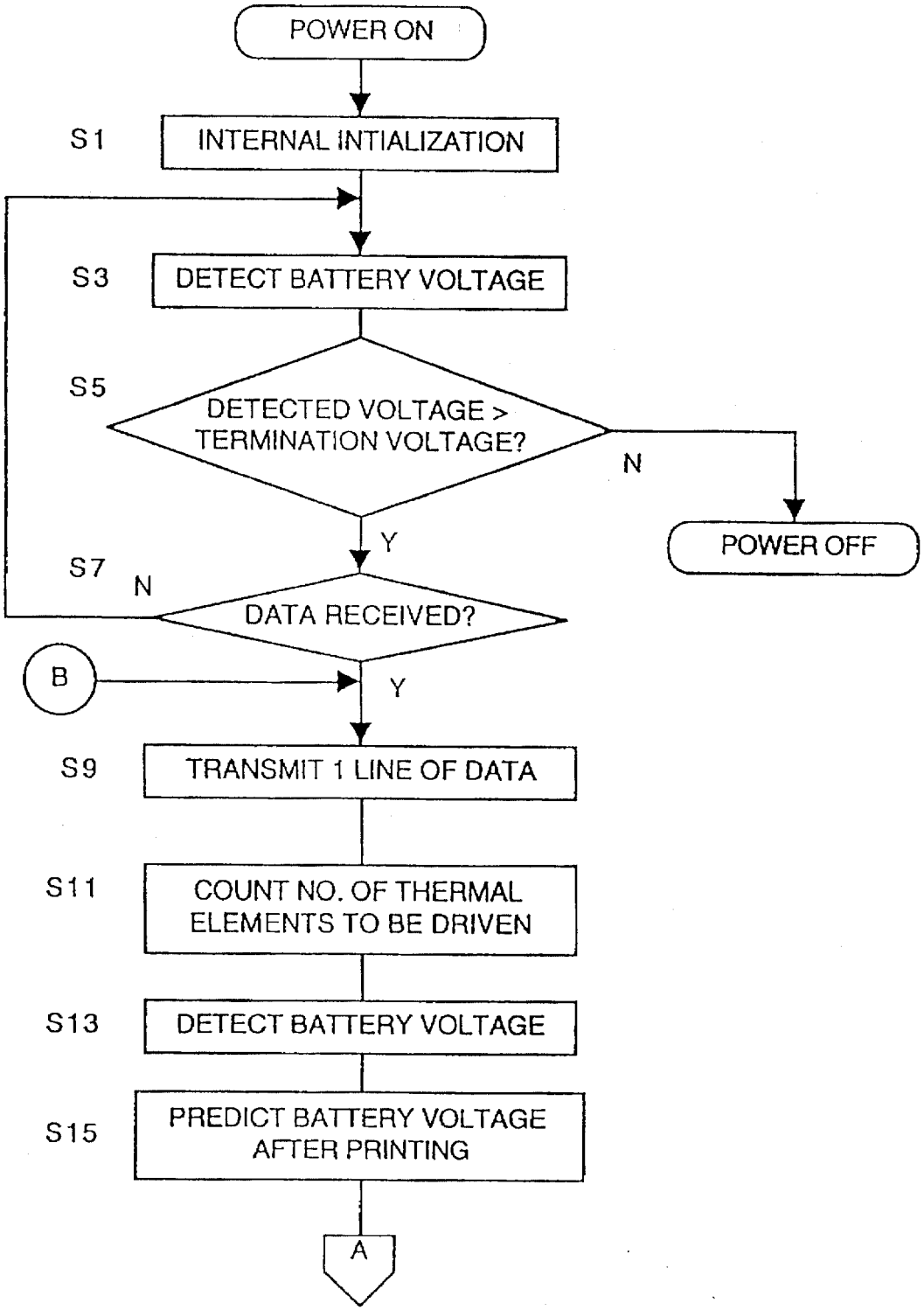
FIGS. 5A and 5B show a flowchart of the control of the thermal printer shown in FIG. 1.
Figure 5B:
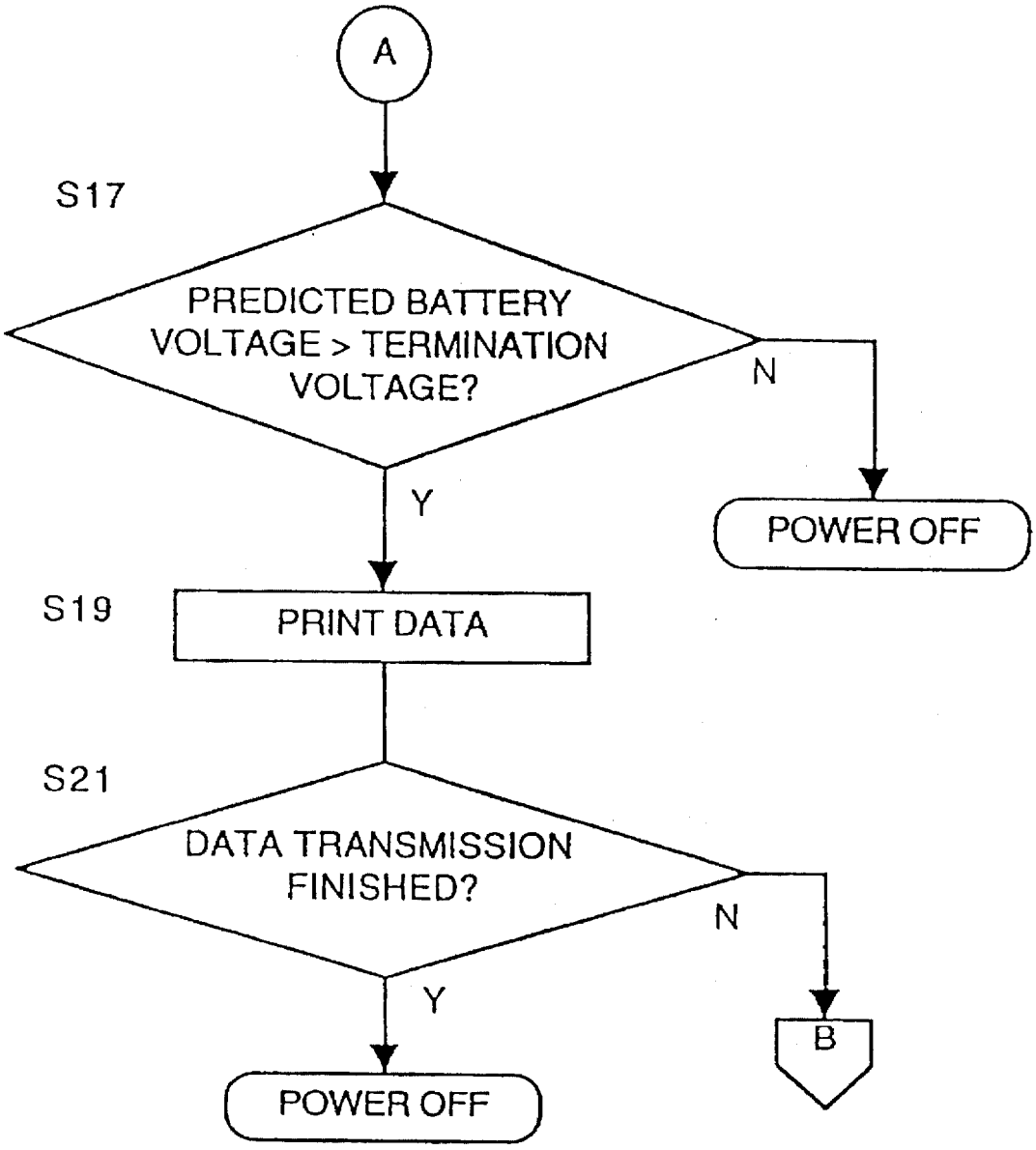

FIGS. 5A and 5B show a flowchart of an operation of the thermal printer embodying the present invention. In this operation, only the battery supplies power to thermal printer.

When the power to thermal printer is turned ON, the thermal printer initializes a memory, and printing parameters are set in step S1. The battery voltage is then detected in step S3, and compared with a reference termination voltage value in step S5. If the battery voltage is less than or equal to the termination voltage (S5:N), the printer cannot operate properly, and thus the power is turned OFF.

If the battery voltage is greater than the termination voltage (S5:Y), then step S7 determines whether data to be printed has been received. If data has not been received (from an external source such as a host computer, S7:N) then control returns to step S3, where the battery voltage is again detected.

If data is received (S7:Y), then a bit map is developed in the DRAM, and a portion of the data to be printed is transmitted to the shift registers 40A and 40B. In this embodiment, one line of data is transmitted to the shift registers 40A and 40B. Step S11 then determines the number of thermal elements to be energized, based on the data stored in the shift registers 40A and 40B. The battery voltage is detected in step S13. The voltage of the battery after printing is predicted in step S15 based on the detected battery voltage and the number of thermal elements to be energized. In this embodiment, the thermal printer has a lookup table which stores predicted voltage values as a function of the detected battery voltage and the number of thermal elements to be driven. The lookup table is stored in the EEPROM. Therefore, the predicted voltage value is determined by referring to the lookup table.

The predicted battery voltage is then compared with the termination voltage, in step S17. If the predicted battery voltage is less than or equal to the termination voltage, the power is turned OFF. If the predicted battery voltage is greater than the termination voltage (S17:Y), the data is printed in step S19. Step S21 determines whether the data transmission has finished. If there is more data to be printed (S21:N), control returns to step S9, and the next line of data is sent to the shift registers 40A and 40B. Otherwise the power is turned OFF.

Thus, as described above, before the line is printed, the thermal printer will predict the value of the voltage of the battery after it prints the next line. Therefore, the thermal printer can determine whether to continue printing based on whether the predicted voltage is above the termination voltage. Further, the prediction of the battery voltage takes into consideration the number of thermal elements to be energized (i.e., the printing ratio) and the detected battery voltage. Therefore, the predicted battery voltage can vary in accordance with the printing ratio. This variation in predicted battery voltage is shown in FIGS. 6 and 7.

Figure 6:
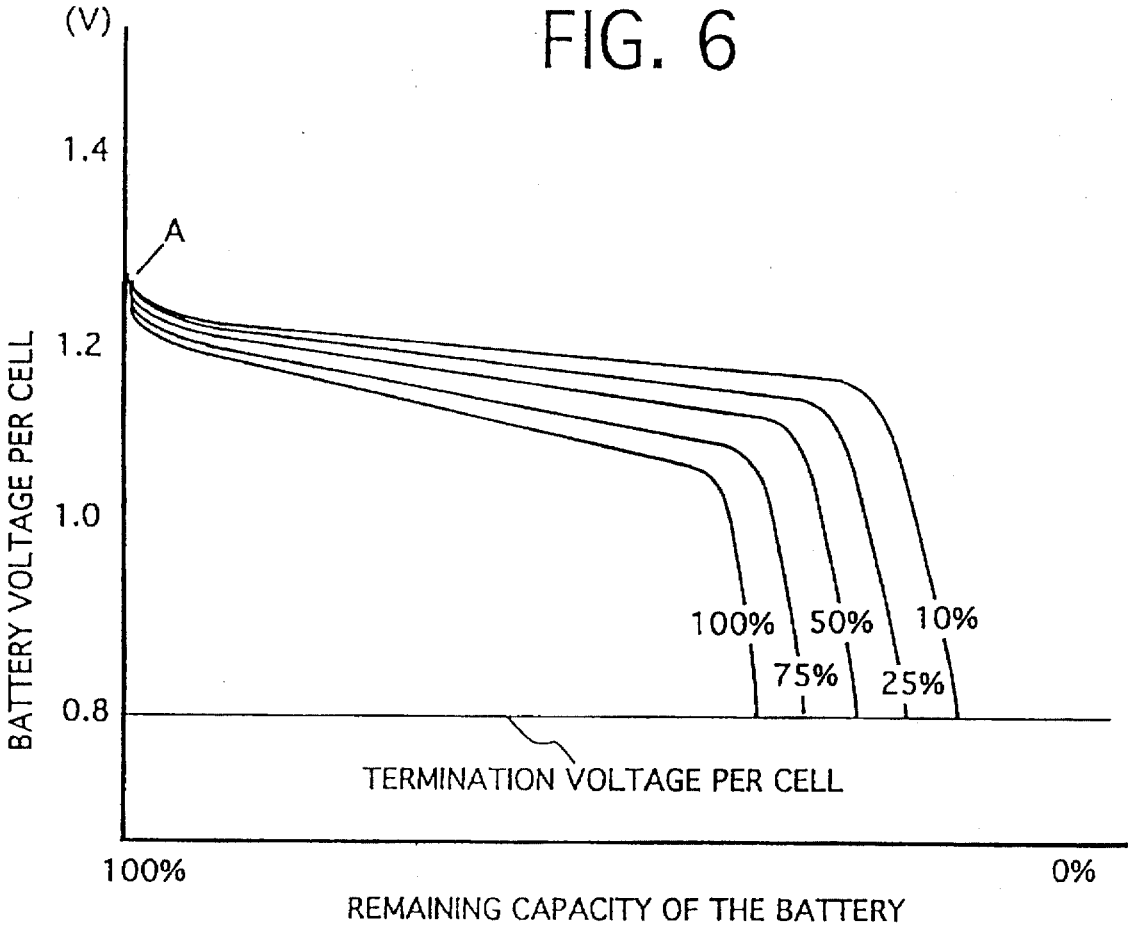
FIGS. 6 and 7 show relationships between the battery voltage and the remaining capacity of the battery for different printing ratios.

FIG. 6 shows the relationship between the battery voltage per cell and the remaining capacity of the battery, for different printing ratios. The battery voltage per cell is equal to the total battery voltage divided by the number of cells in the battery.

As shown in FIG. 6, when the battery is fully charged (i.e., the remaining capacity is 100%), the voltage per cell is between 1.2V and 1.4V. Five curves illustrate the change in the remaining capacity of the battery and voltage of each cell, when the printing ratio is 100%, 75%, 50%, 25% and 10%, respectively.

Figure 7:
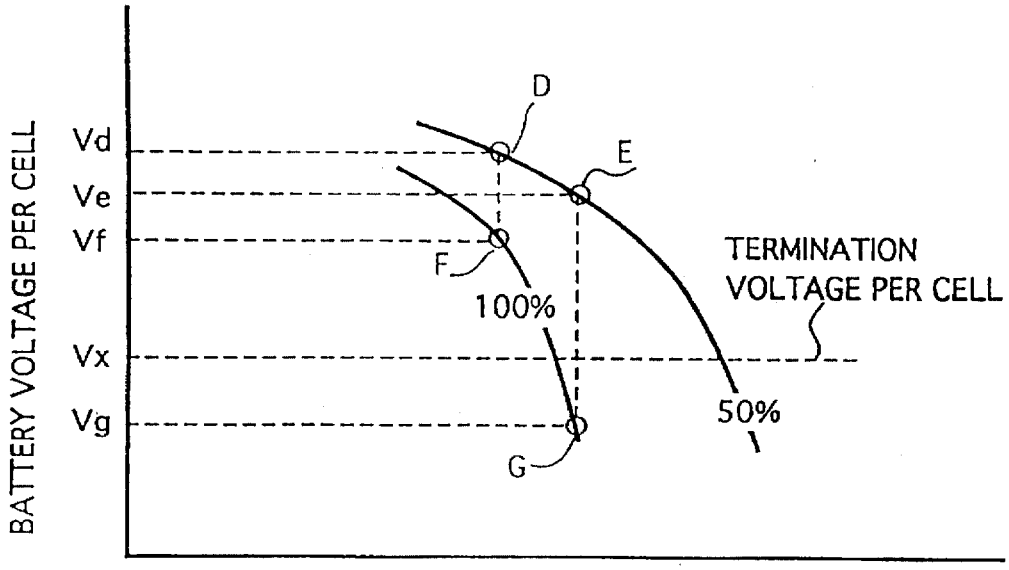

FIG. 7 is an enlarged view of FIG. 6, and shows the curves corresponding to printing a line having a printing ratio of 100% and 50%, respectively.

As shown in FIG. 7, at a point D, a line having a 50% printing ratio has been printed and the voltage per cell of the battery is vd. If the next line to be printed also has a printing ratio of 50%, then the voltage per cell of the battery after the next line is printed, will be Ve (shown by point E). Since voltage Ve is greater than the termination voltage per cell Vx, and the next line can print.

However, if the next line to be printed has a printing ratio of 100%, the voltage per cell of the battery initially drops to Vf (shown by pint F) and would then drop to Vg (shown by point G), after the next line is printed. Since voltage Vg is less than the termination voltage per cell Vx, the next line cannot print, and the power is turned OFF.

In the above description, the voltage per cell of the battery is illustrated. However, the determination that the battery voltage is lower than the termination voltage is done by comparing the total battery voltage with the termination voltage. In other words, the total voltage of the battery is detected in step S3 and the total voltage of the battery is predicted in step S17, in the flow chart shown in FIGS. 5A and 5B.

Thus, as described above, the voltage of the battery after a line is printed, is predicted, and based on the predicted voltage, the CPU determines whether the battery has enough capacity to print the line. Further, the CPU takes the printing ratio of the line to be printed into consideration when determining whether the battery has enough capacity to print the line.

Further, in the embodiment described above, only the power consumed by the thermal elements is considered. However, the power consumption by the CPU and related circuitry can also be considered in order to improve the accuracy of predicting the voltage of the battery after the line has been printed.

What is claimed is:

1. A printer comprising:

image forming means for forming a portion of an image in accordance with image data;

a built-in battery for providing energy to said image forming means;

predicting means for predicting whether a remaining capacity of said battery, after said portion of said image has been formed, will be larger than a predetermined value;

driving means for driving said image forming means to form said portion of said image; and inhibiting means for inhibiting said driving means from driving said image forming means if said remaining capacity is predicted to be less than said predetermined value.

2. The printer according to claim 1, further comprising detecting means for detecting an initial voltage of said battery before forming said portion of said image, wherein said predicting means predicts said remaining capacity based on said initial voltage and said image data of said portion of said image to be formed.

3. The printer according to claim 1, wherein said image forming means comprises:

a thermal head having a plurality of linearly arranged thermal elements;

determining means for determining a number of said thermal elements to be driven to form said portion of said image in accordance with said image data, and wherein said predicting means predicts said remaining capacity based on said number of said thermal elements to be driven.

4. The printer according to claim 3, wherein said number of said thermal elements to be driven to form said portion of said image corresponds to a printing ratio of said portion of said image.

5. The printer according to claim 3, wherein said predicting means predicts whether a final voltage of said battery after said portion of said image has been formed, will be larger than a predetermined voltage value, and wherein said predicting means predicts said remaining capacity in accordance with said final voltage of said battery and said number of thermal elements to be driven.

6. The printer according to claim 5, wherein said predetermined voltage value corresponds to a termination voltage value.

7. The printer according to claim 1, wherein said battery is a Nickel Cadmium battery.

8. A portable printer comprising:

image forming means for forming a line image on a recording sheet in accordance with image data;

a built-in battery for providing energy to said image forming means;

determining means for determining a printing ratio of a line of said image to be formed;

predicting means for predicting whether a final voltage of said battery after said line of said image has been formed, will be larger than a predetermined value, said predicting means predicting said final voltage in accordance with said printing ratio; and driving means for driving said image forming means to form said line image only if said final voltage is predicted to be larger than said predetermined value.

9. The printer according to claim 8, wherein said image forming means comprises a thermal head having a plurality of linearly arranged thermal elements, and wherein said printing ratio is determined in accordance with a number of said thermal elements to be driven to form said line image.

10. A method for forming a line of an image on a recording sheet using a printer having a built-in battery, said method comprising:

detecting an initial voltage of said built-in battery before said line of said image is formed;

determining a printing ratio of said line of said image to be printed, based on image data corresponding to said line of said image;

predicting whether a remaining capacity of said battery after said line of said image has been formed, will be larger than a predetermined value; and forming said line of said image if a final voltage is predicted to be larger than said predetermined value.

11. The method according to claim 10, wherein said printer includes a thermal line head having a plurality of thermal elements, said determining step determines said printing ratio in accordance with a number of thermal elements to be driven to form said line image in accordance with said line image, and wherein said predicting step predicts said remaining capacity based on said number of said thermal elements to be driven.

* * * * *